US005320569A

United States Patent [19]

Oshima et al.

[11] Patent Number: 5,320,569

[45] Date of Patent: Jun. 14, 1994

[54] METHOD OF MAKING A SPARK PLUG

[75] Inventors: Takafumi Oshima; Mamoru Musasa; Tsutomu Okayama; Kazuya Iwata, all of Nagoya, Japan

[73] Assignee: NGK Spark Plug Co., Ltd., Nagoya, Japan

[21] Appl. No.: 96,435

[22] Filed: Jul. 26, 1993

[30] Foreign Application Priority Data

Jul. 27, 1992 [JP] Japan ..... 4-199629
Aug. 24, 1992 [JP] Japan ..... 4-224190

[51] Int. Cl.[5] ..... H01T 21/02
[52] U.S. Cl. ..... 445/7; 219/121.64
[58] Field of Search ..... 445/7; 219/121.14, 121.64; 313/143, 144

[56] References Cited

U.S. PATENT DOCUMENTS 4,695,699 9/1987 Yagii et al. ..... 219/121.64
4,904,216 2/1990 Kagawa et al. ..... 445/7
4,963,112 10/1990 Benedikt et al. ..... 445/7

FOREIGN PATENT DOCUMENTS 57-151183 9/1982 Japan .
63-57919 11/1988 Japan .
249388 2/1990 Japan .

*Primary Examiner*—Kenneth J. Ramsey
*Attorney, Agent, or Firm*—Sughrue, Mion, Zinn, Macpeak & Seas

[57] ABSTRACT

In a method of making a spark plug, a recess is provided on an end surface of the electrode blank metal. A straight neck portion is provided around the recess, and forming a tapered surface connecting from the straight neck portion toward an opposite side of the recess. A disc-shaped tip is placed in the recess of the electrode blank metal. The disc-shaped tip is pressed against an inner bottom of the recess in the axial direction of the electrode blank metal, and a laser beam welding is applied to an outer wall of the recess substantially all through its circumferential length by rotating the electrode blank metal.

6 Claims, 10 Drawing Sheets 1
1A
1B
2
3
4
11
12
13
14
15
16
17
18
21
L1
Lb

METHOD OF MAKING A SPARK PLUG

BACKGROUND OF THE INVENTION

1. Field of the Invention

This invention relates to a method of making a spark plug in which a noble metal tip is secured to a front end of a center electrode to impart a spark-erosion resistant property.

2. Description of Prior Art

In a center electrode of a spark plug, a composite structure has been used in which a heat-conductive core (Cu) is embedded in a heat-and erosion-resistant clad metal (nickel-based alloy) as shown in Japanese Patent Publication No. 59-2152. According to the Japanese Patent Publication No. 59-2152, a noble firing tip is further bonded to a front end of the clad metal by means of electric resistance welding so as to improve its spark-erosion resistant property. After completing the electric resistance welding, the front end of the clad metal is milled to make the front end diametrically even with the firing tip.

In the prior art, the electric resistance welding makes it possible to embed the tip in the front end of the clad metal while rounding an edged corner of the firing tip under the influence of the heat and pressure to which the firing tip is subjected.

As a result, a higher voltage is required for the spark plug to establish a spark discharge between its electrodes. Upon cutting the front end of the clad metal in order to reduce the required spark voltage and improve the ignitability, it is unavoidable to mill the firing tip only to fail to make an effective use of the expensive noble metal.

When the front end of the clad metal is eroded to reveal the rounded corner of the firing tip only with a short elapse of service hours, a significantly higher voltage is required for the spark plug to establish the spark discharge between its electrodes.

Therefore, it is one of the objects of the invention to provide a method of making a spark plug which is capable of preventing a buckling collapse of the nobel metal tip, and reducing a required spark voltage while at the same time keeping an edged corner of the tip in good shape.

SUMMARY OF THE INVENTION

According to the invention, a method of making a spark plug which includes an electrode blank metal having a barrel portion and diameter-reduced straight neck portion to which an erosion resistant disc-shaped tip is secured, and comprising steps of: preparing an electrode blank metal: providing a recess on a front end surface of the electrode blank metal; providing a straight neck portion around the recess, and forming a tapered surface connecting from the straight neck portion toward an opposite side of the recess; placing a disc-shaped tip in the recess of the electrode blank metal; pressing the disc-shaped tip against an inner bottom of the recess in the axial direction of the electrode blank metal, and applying a laser beam welding to an outer wall of the recess substantially all through its circumferential length by rotating the electrode blank metal so as to form a wedge-shaped welding solidification portion at the outer wall of the recess.

By bonding the disc-shaped tip to the front end of the straight neck portion of the electrode blank metal by means of the laser beam welding, it is possible to protect the edged corner of the tip against deformation.

The recess of the straight neck portion makes it possible to serve as a guide which places the disc-shaped tip in position to keep the tip in stable shape after completing the laser beam welding.

By placing the disc-shaped tip in the recess, and applying the laser beam welding through the outer wall of the recess, it is possible to sufficiently reduce pin holes and variation of penetrated depth of the welded portion which occur in the case where the absorption rate of the laser beams significantly differs between members such as, for example, the noble metal and the nickel metal.

According further to the invention, a dimensional relationship on D, T, A, B, d and L is as follows:

$$0.5\ \text{mm} \leqq D \leqq 1.5\ \text{mm},$$

$$0.3\ \text{mm} \leqq T \leqq 0.6\ \text{mm},$$

$$0.01\ \text{mm} \leqq (A-D) \leqq 0.1\ \text{mm},$$

$$0.05\ \text{mm} \leqq B \leqq 0.2\ \text{mm},$$

$$0.05\ \text{mm} \leqq (d-A)/2 \leqq 0.2\ \text{mm}.$$

$$0.2\ \text{mm} \leqq L \leqq 0.5\ \text{mm}.$$

where (D) is a diameter of the disc-shaped tip,
(T) is a thickness of the disc-shaped tip,
(A) is a diameter of the recess,
(B) is a depth of the recess,
(d) is a diameter of the straight neck portion, and
(L) is a length of the straight neck portion.

With the dimensional relationship between D, T, A, B, d and L concretely determined, it is possible to physically strengthen the bonding between the disc-shaped tip and the front end of the straight neck portion of the electrode blank metal with the minimum pin holes and variation of penetrated depth of the welded portion while keeping the edged corner of the tip in a good shape.

With the disc-shaped tip made of a noble metal, it is possible to significantly reduce an amount of spark erosion so as to contribute to an extended service life.

According stillfurther to the invention, a method of making a spark plug which includes an electrode blank metal having a barrel portion and a diameter-reduced straight neck portion to which an erosion resistant disc-shaped tip is secured, and comprising steps of preparing an electrode blank metal having a barrel portion and a diameter-reduced straight neck portion; forming a tapered surface progressively connecting from the straight neck portion to the barrel portion; placing a disc-shaped tip on a front end surface of the electrode blank metal; axially pressing the disc-shaped tip against the front end surface of the electrode blank metal, and applying a laser beam welding to an interface between the disc-shaped tip and the front end surface of the electrode blank metal substantially all through its circumferential length by rotating the electrode blank metal, and forming a welding solidification portion all through the interface therebetween.

In a method of making a spark plug a dimensional relationship on D, T, d and L is as follows:

$$0.5\ \text{mm} \leqq D \leqq 1.5\ \text{mm},$$

$0.3\ mm \leqq T \leqq 0.6\ mm$, $0.0\ mm \leqq (d-D)/2 \leqq 0.2\ mm$, $0.2\ mm \leqq L \leqq 0.5\ mm$.

where (D) is a diameter of the disc-shaped tip, (T) is a thickness of the disc-shaped tip, (d) is a diameter of the straight neck portion, and (L) is a length of the straight neck portion.

These and other objects and advantages of the invention will be apparent upon reference to the following specification, attendant claims and drawings.

DETAILED DESCRIPTION OF THE EMBODIMENTS

Figures 1A, 1B, 1C, 1D:
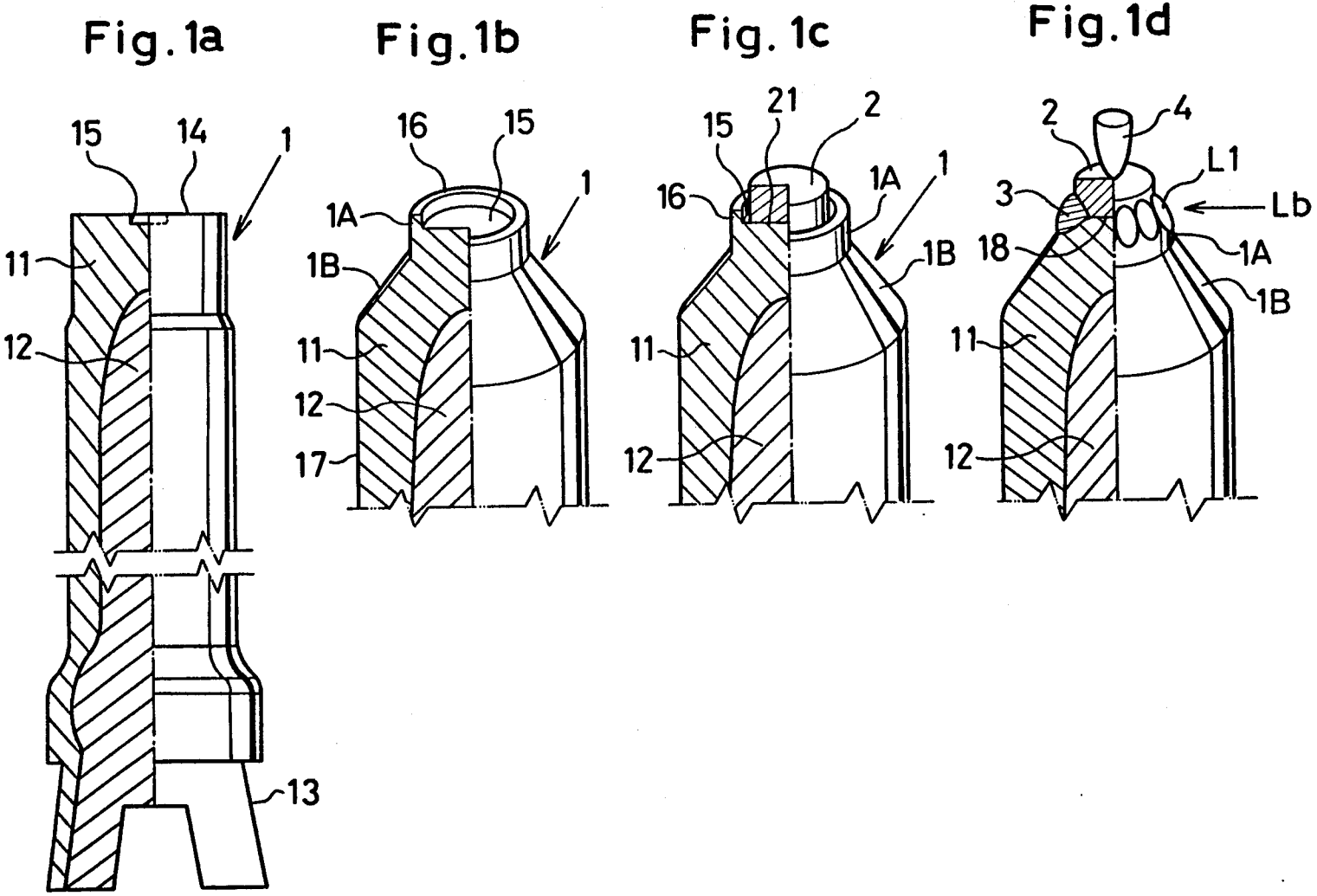
FIGS. 1*a*~1*d* are schematic views showing a sequential process of making a center electrode according to a first embodiment of the invention.

Referring to FIGS. 1*a*~1*d* which show a sequential process of a center electrode according to a first embodiment of the invention, the center electrode is manufactured as follows:

In a first step shown in FIG. 1*a*, an electrode blank metal 1 is prepared by embedding a heat-conductive core (Cu or Ag) 12 in a columnar clad metal 11 by means of a plastic working. The clad metal 11 is made of an Inconel 600 (Ni-Cr-Fe alloy) or a nickel-alloyed metal containing Si, Mn and Cr. During the process in which the embedding the heat-conductive core (Cu or Ag) 12 in the clad metal 11, a small recess 15 is provided at a front end surface (spark discharge end) 14 of the electrode blank metal 1 by a lug portion (not shown) provided on a press pin which presses the front end surface 14 at the time of forming a flange tail 13 on a rear end of the electrode blank metal 1.

In a second step shown in FIG. 1*b*, a diameter-reduced straight neck portion 1A is concentrically provided around the small recess 15 by milling a front end of the electrode blank metal 1. The straight neck portion 1A has a diameter greater than the small recess 15, but smaller than a barrel portion 17 of the electrode blank metal 1. Upon forming the straight neck portion 1A, a tapered surface 1B is provided between the straight neck portion 1A and the barrel portion 17 in a manner to progressively connect toward the barrel portion 17.

In a third step shown in FIG. 1*c*, a bottom end 21 of a disc-shaped tip 2 is placed in the small recess 15 to be electrically in contact with an inner bottom 18 of the recess 15. In this instance, the tip 2 is made of a thin metal such as Pt-Ir alloy, Au, Pt, Ir or Ir-alloy containing an oxide of the rare earth metal.

In a fourth step shown in FIG. 1*d*, laser beam welding is carried out by useing YAG (yttrium, aluminum and garnet) laser beams (Lb) emitted in the direction parellel to the inner bottom 18 of the recess 15 with one shot energy as 2.0 Joules. The laser beams (Lb) are applied intermittently to an outer wall 16 of the recess 15 substantially all through its circumferential length, while at the same time, the tip 2 is tightly engages against the inner bottom 18 of the recess 15 by means of a press jig 4. During the process of applying the laser beams (Lb), the laser beams (Lb) are emitted sufficient times to at leat partly overlap the neighboring shot spots (L1) substantially all through its circumferential length. In each of the shot spots (L1), a welding solidification portion 3 is formed in which the tip 2 and the straight neck portion 1A are partly melted each other so as to tightly secure the tip 2 to the straight neck portion 1A.

In this instance, the tip 2 is welded to the straight neck portion 1A through the outer wall 16 of the recess 15, thus making it possible to reduce blow holes and variation of the penetrated depth of the welded portion under the circumstances that there is a significant difference in laser beam absorption rate between the tip 2 and the straight neck portion 1A.

The welding solidification portion 3 is such that it has an intermediate physical property (e.g. thermal expansional coefficient) between the straight neck portion 1A and the tip 2. This makes it difficult to inadvertently fall the tip 2 off the straight neck portion 1A due to the thermal expansional difference therebetween when the front end of center electrode is exposed to a high temperature environment.

Figure 2A:
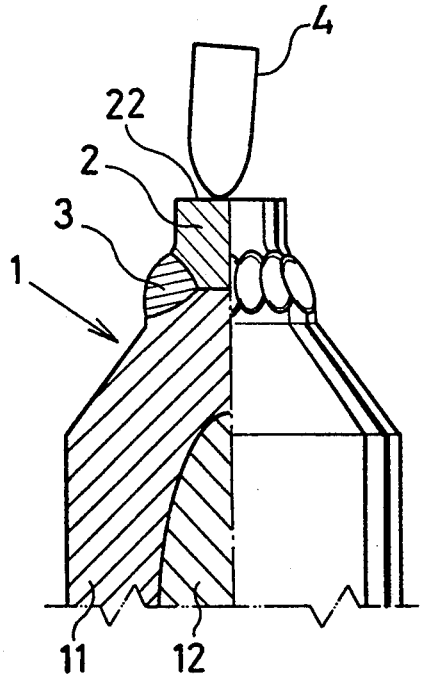
FIG. 2*a* is a plan view of a front portion of the center electrode in which a laser beam welding is carried out with a press jig being used, but a left half of the front portion of the center electrode is sectioned.
Figure 2B:
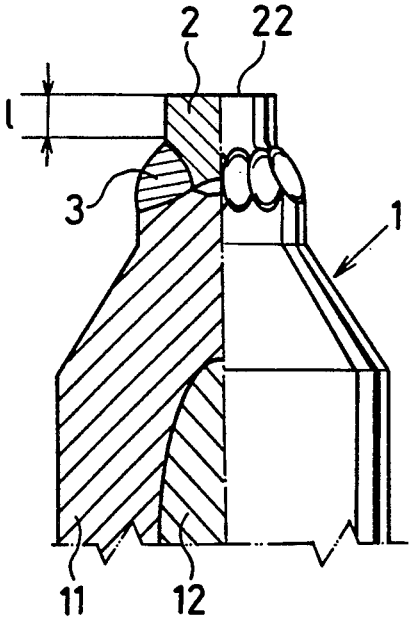
FIG. 2*b* is a longitudinal cross sectional view of the front portion of the center electrode in which the laser beam welding is carried out without using the press jig, but a left half of the front portion of the center electrode is sectioned.

During carrying out the laser beam welding as described in the fourth step, a front portion of the disc-shaped tip 2 is subjected to an axial elongation (1) as shown in FIG. 2*b*. However, the use of the press jig 4 prevents the axial elongation (1) since the press jig 4 keeps to impose 1 kg load on the disc-shaped tip 2 in the direction in which the tip 2 tightly engages against the inner bottom 18 of the recess 15 as shown FIG. 2*a*. The use of the press jig 4 also prevents the tip 2 from inadvertently slipping out of the normal place during carrying out the laser beam welding.

Figure 3:
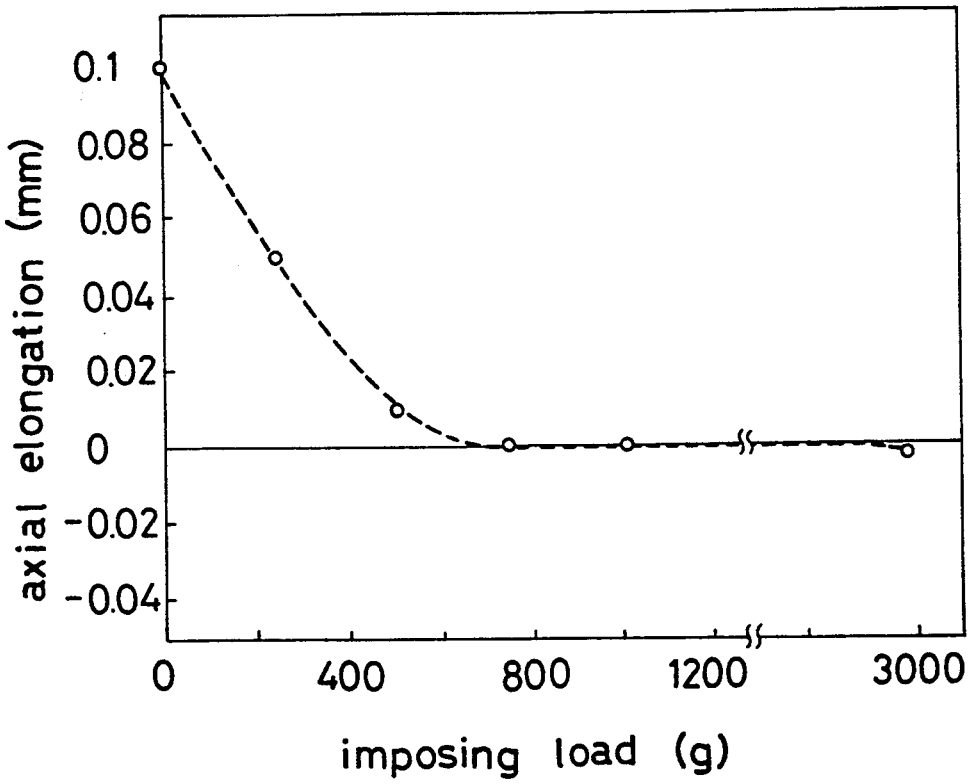
FIG. 3 is a graph showing a relationship between a load (g) of the press jig and an axial elongation (1 mm) of the disc-shaped tip.

FIG. 3 is a graph showing a relationship between the imposing load (g) and the axial enlongation (1 mm) of the tip 2. It is found that the axial elongation (1) is appreciable when the imposing load is less than 500 g, but the press jig 4 leaves its imposing mark on a front end surface 22 of the tip 2 when the load exceeds 3000 g as understood from FIG. 3. The imposing load is preferably in the range of 600 g to 2500 g.

Figure 4:
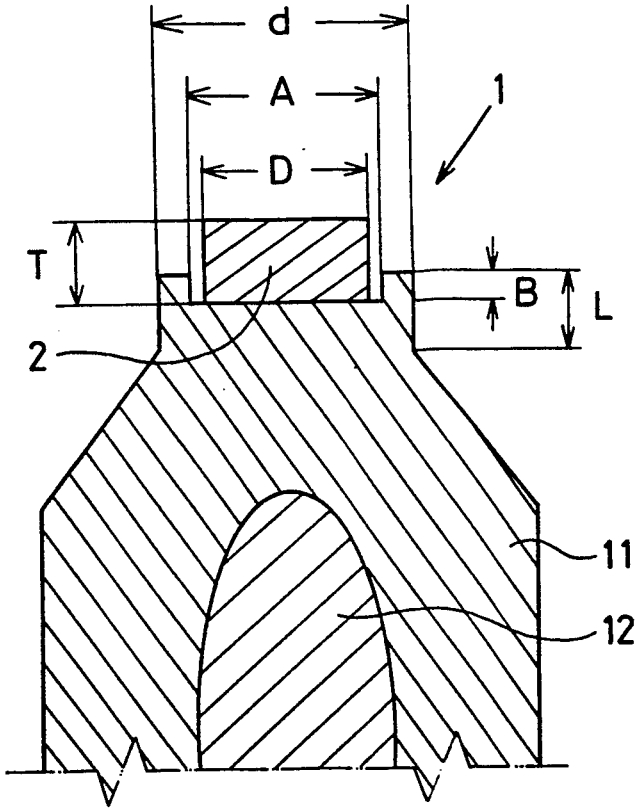
FIG. 4 is a longitudinal cross sectional view of the front portion of the center electrode to show a dimensional relationship on D, T, A, B, d and L.

As shown in FIG. 4, a dimensional relationship on D, T, A, B, d and L is as follows:

$0.5\ mm \leqq D \leqq 1.5\ mm$, $0.3\ mm \leqq T \leqq 0.6\ mm$, $0.01\ mm \leqq (A-D) \leqq 0.1\ mm$, $0.05 \leqq B \leqq 0.2$, $0.05\ mm \leqq (d-A)/2 \leqq 0.2\ mm$, and $0.2\ mm \leqq L \leqq 0.5\ mm$ Where (D) is a diameter of the disc-shaped tip 2,
(T) is a thickness of the disc-shaped tip 2,
(A) is a diameter of the recess 15 of the straight neck portion 1A,
(B) is a depth of the recess 15 of the straight neck portion 1A,
(d) is a diameter of the straight neck portion 1A and
(L) is a length of the straight neck portion 1A.

Figure 5:
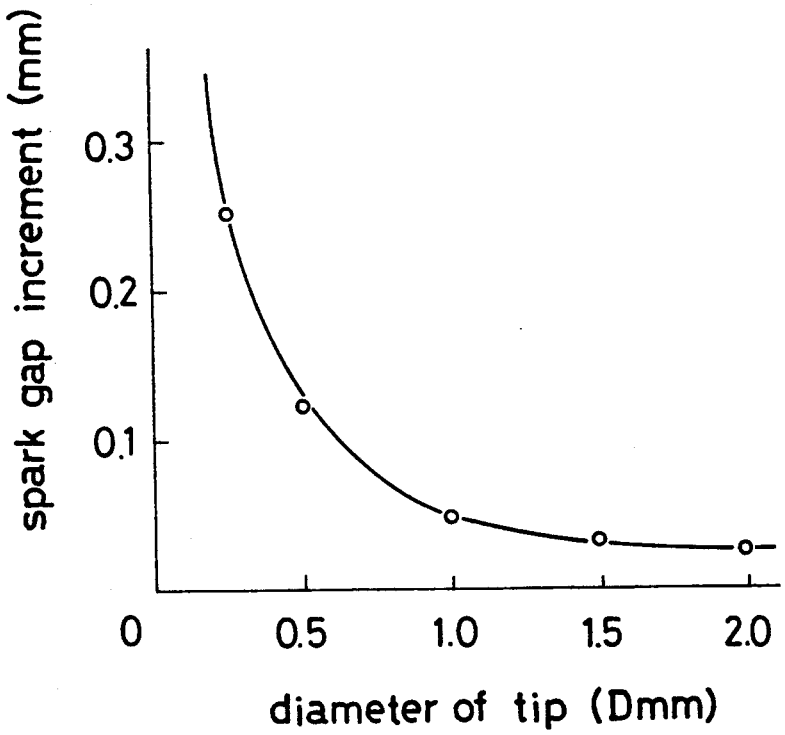
FIG. 5 is a graph showing a relationship between a diameter of the disc-shaped tip and a spark gap increment.

FIG. 5 shows a graph how the spark gap changes depending on the diameter (D) of the disc-shaped tip 2. The graph is obtained after carrying out an endurance experiment test at full throttle (5000 rpm) for 300 hrs with the spark plug 100 mounted on an internal combustion engine (six-cylinder, 2000 cc).

As apparent from FIG. 5, the spark discharge concentrates on the tip 2 to rapidly increase the spark gap when the diameter (D) of the tip 2 is less than 0.5 mm. That is to say, the diameter (D) less than 0.5 mm promptly develops the spark erosion of the tip 2 although the voltage required for the spark plug to discharge is reduced with the decrease of the diameter (D).

Meanwhile, the diameter (D) exceeding 1.5 mm causes to worsen the ignitablity by the increased surface area of the tip 2, and at the same time, increasing an amount of the noble metal to make it costly.

Figure 6:
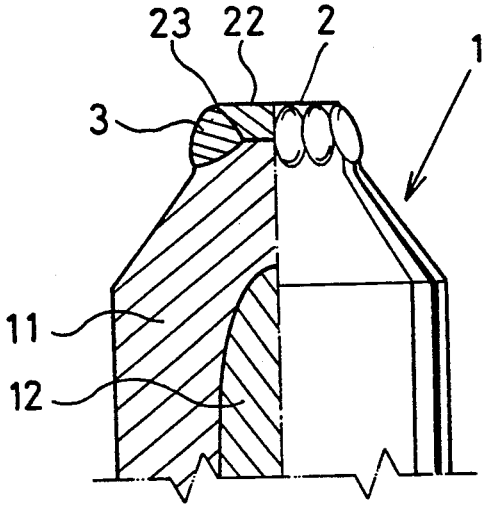
FIG. 6 is a plan view of the front portion of the center electrode when a thickness of a disc-shaped tip is less than 0.3 mm, but its left half is sectioned.

FIG. 6 shows the front end portion of the center electrode in which the thickness (T) of the tip 2 is less than 0.3 mm. When the thickness (T) is less than 0.3 mm, an edged corner 23 of the tip 2 is rounded at the time of applying the laser beam welding so as to increase the voltage required for the spark plug to establish the spark discharge.

The reason why the thickness (T) of the tip 6 is less than 0.6 mm is that the amount of the noble metal not involved in the spark-erosion resistance increases to make it costly when the thickness (T) exceeds 0.6 mm.

In connection with the diameter (A) of the recess 15, the diameter (A) is 0.85 mm while the depth (B) of the recess 15 is 0.15 mm by way of illustration. The tip 2 is not smoothly placed in the recess 15 when the differential dimension (A-D) is less than 0.01 mm. When the differential dimension (A-D) exceeds 0.1 mm, the tip 2 easily slips out of place so as to fail to serve as a guide which places the tip 2 in position. Therefore, it is preferable that the diameter (A) is greater than the diameter (D) of the tip 2 by 0.05~0.07.

When the depth (B) of the recess 15 is too short, the tip 2 easily slips out of place so as to fail to serve as a guide which places the tip 2 in position. A greater depth (B), however, makes the life of the lug portion of the press pin short. Therefore, it is preferable that the depth (B) is in the range of 0.05 mm to 0.2 mm (more preferably 0.1 mm~0.15 mm).

The dimension (D−A)/2 which is equivalent to a thickness of the outer wall 16 of the recess 15 is in the range of 0.05 mm~0.2 mm. When the dimension (D−A)/2 is less than 0.05 mm, the wall 16 becomes short of mechanical strength so that the wall 16 is readily deformed even with a small amount of an outer force. When the dimension (D−A)/2 exceeds 0.2 mm, it is possible to obtain a sufficient length in which the welding solidification portion 3 penetrates toward the tip 2 since the tip is welded through the outer wall 16. This also makes possible to increase the variation of the penetrated length of the welding solidification portion 3.

When the length (L) of the straight neck portion 1A is less than 0.2 mm, the heat of the laser beam welding is partially drawn from the clad metal 11 to the heat-conductive core 12. This makes it difficult to evenly melt the tip 2 and the straight neck portion 1A each other.

When the length (L) of the straight neck portion 1A exceeds 0.5 mm, the clad metal 11 is exposed to an increased amount of the laser beam heat so as to develop blow holes or cracks in the welding solidification portion 3 at the time of carrying out the laser beam welding particularly because the clad metal 11 has a melting point smaller than the tip 2.

According to the invention, the tip 2 is secured to the straight neck portion 1A by means of the laser beam welding so that the tip 2 is prevented from buckling down while keeping the corner of the tip 2 in good shape. The provision of the recess 15 makes it possible to prevent the tip 2 from slipping out of place at the time of placing the tip 2 in the recess 15. With the laser beams (Lb) shot through the outer wall 16 of the recess 15, it makes possible to prevent the blow holes or cracks from developing in the welding solidification portion 3 at the time of carrying out the laser beam welding.

In the above embodiment of the invention, the recess 15 is provided on the front end surface 14 of the electrode blank metal 1 in the first step, and the straight neck portion 1A and the tapered surface 1B are provided by means of milling procedure in the second step. However, the second step may precede the first step in which the straight neck portion 1A and the tapered surface 1B is provided in the first step, and the recess 15 is provided in the second step.

Otherwise, the recess 15, the straight neck portion 1A and the tapered surface 1B may be concurrently provided by means of milling procedure so as to make the first and second steps unify.

Figure 7A:
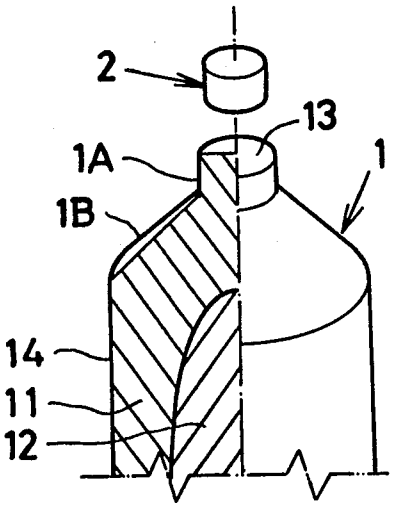
FIGS. 7*a*~7*c* are schematic views showing a sequential process of making a center electrode according to a second embodiment of the invention.
Figure 7B:
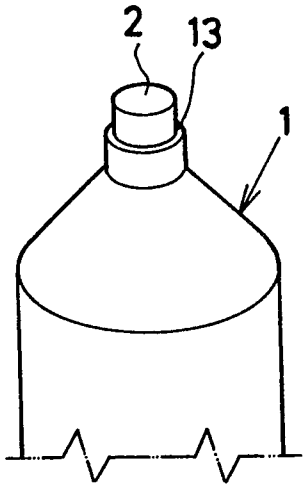
Figure 7C:
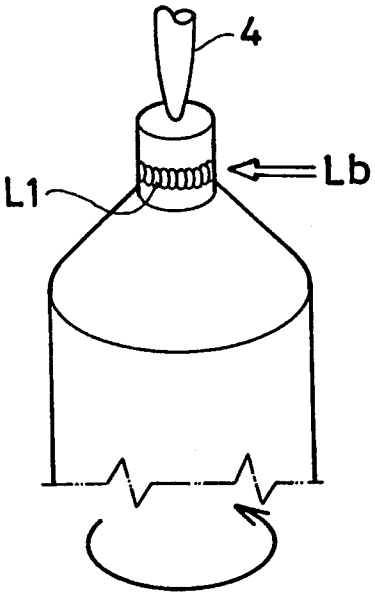
Figure 8A:
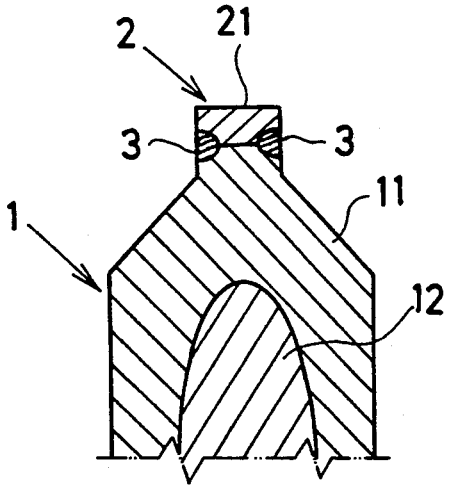
FIGS. 8*a* and 8*b* are views similar to FIGS. 2*a* and FIG. 2*b;*
Figure 8B:
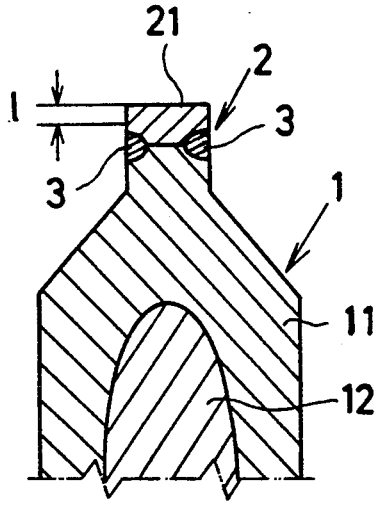

Referring to FIGS. 7*a*~7*c* which shows a sequential process of the center electrode 1 according to a second embodiment of the invention.

In a first step shown in FIG. 7*a*, the center electrode blank metal 1 is prepared by embedding the heat-conductive core (Cu or Ag) 12 in the columnar clad metal 11 by means of the plastic working. The clad metal 11 is made of Inconel 600 (Ni-Cr-Fe alloy) or the nickel-alloyed metal containing Si, Mn and Cr. The electrode blank metal has a cone-shaped portion which connects the straight neck portion 1A to the barrel portion 14 by means of milling or plastic working. The straight neck portion 1A (0.85 mm in diameter and 0.25 mm) in height) is diametrically smaller than the barrel portion 14. The disc-shaped noble metal tip 2 is 0.8 mm in diameter and 0.5 mm) in height.

A shown in FIG. 7*b*, the center electrode blank metal 1 has the heat-conductive core 12 in the columnar clad metal 11 and the tip 2 placed on the straight neck portion 1A to cover the front end surface 13 of the clad metal 11. In this instance, the tip 2 is made of a thin metal such as Pt-Ir alloy, Au, Pt, Ir or Ir-alloy containing an oxide of the rare earth metal.

In a third step shown in FIG. 7*c*, the laser beam welding is carried out by using YAG (yttrium, aluminum and garnet) laser beams (Lb) emitted in the direction parellel to the interface between the straight neck portion 1A and the tip 2 with one shot energy as 2.0 Joules. The laser beams (Lb) are applied intermittently to the interface substantially all or entire through its circumferential length, while at the same time, the tip 2 is tightly engages against the front end surface 13 of the straight neck portion 1A by means of the press jig 4. During the process of applying the laser beams (Lb), the laser beams (Lb) are emitted sufficient times (plurality) to at leat partly overlap the neighboring shot spots (L1) substantially all or entire through its circumferential length. In each of the shot spots (L1), the welding solidification alloy portion 3 is formed in which the tip 2 and the straight neck portion 1A are partly fused each other so as to tightly secure the tip 2 to the straight neck portion 1A.

The welding solidification alloy portion 3 is such that it has an intermediate physical property (e.g. thermal expansional coefficient) between the straight neck portion 1A and the tip 2. This makes it difficult to inadvertently fall the tip 2 off the straight neck portion 1A due to the thermal expansional difference therebetween when the front end of center electrode is exposed to a high temperature environment.

During carrying out the laser beam welding as described in FIG. 7*b*, the front portion of the disc-shaped tip 2 is subjected to an axial elongation (l) as shown in FIG. 2*b* of the first embodiment of the invention. However, the use of the press jig 4 prevents the axial elongation (l) since the press jig 4 keeps to impose 1 kg load on the disc-shaped tip 2 in the direction in which the tip 2 tightly engages against the front end of the straight neck portion 1A as previously shown in FIG. 2*b*. The use of the press jig 4 also prevents the tip 2 from inadvertently slipping out of the normal place during carrying out the laser beam welding.

As previously shown in FIG. 3 of the first embodiment of the invention, it is found that the axial elongation (1) is appreciable when the imposing load is less than 500 g, but the press jig 4 leaves its imposing mark on a front end surface 22 of the tip 2 when the load exceeds 3000 g as understood from FIG. 3. The imposing load is preferably in the range of 600 g to 2500 g.

Figure 9A:
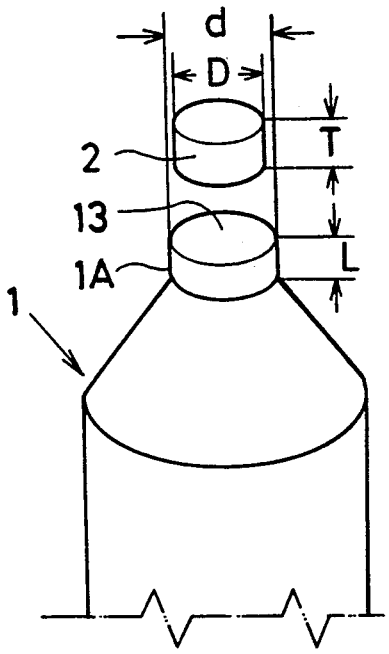
FIGS. 9*a* and 9*b* are views similar to FIG. 4.

As shown in FIG. 9*a*, a dimensional relationship on D, T, B, d and L is as follows: $0.5\ mm \leqq D \leqq 1.5\ mm$, $0.3\ mm \leqq T \leqq 0.6\ mm$, $0\ mm \leqq (d-D)/2 \leqq 0.2\ mm$ and $0.2\ mm \leqq L \leqq 0.5\ mm$.

Where (D) is a diameter of the disc-shaped tip 2, (T) is a thickness of the disc-shaped tip 2, (d) is a diameter of the straight neck portion 1A and (L) is a length of the straight neck portion 1A.

From the previous graph of FIG. 5 which shows how the spark gap changes depending on the diameter (D) of the disc-shaped tip 2. The graph is obtained after carrying out an endurance experiment test at full throttle (5000 rpm) for 300 hrs with the spark plug 100 mounted on an internal combustion engine (six-cylinder, 2000 cc).

As evidenced from FIG. 5 of the first embodiment of the invention, the spark discharge concentrates on the tip 2 to rapidly increase the spark gap when the diameter (D) of the tip 2 is less than 0.5 mm. That is to say, the diameter (D) less than 0.5 mm promptly develops the spark erosion of the tip 2 although the voltage required for the spark plug to discharge is reduced with the decrease of the diamter (D).

Meanwhile, the diameter (D) exceeding 1.5 mm causes to worsen the ignitablity by the increased surface area of the tip 2, and at the same time, increasing an amount of the noble metal to make it costly.

Figure 10:
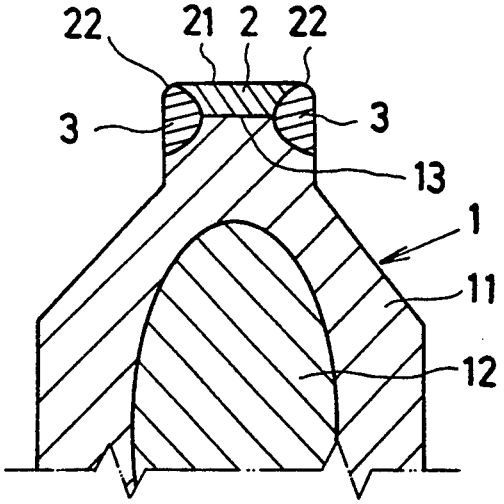
FIG. 10 is a view similar to FIG. 6.

As evident from FIG. 10, the front end portion of the center electrode in which the thickness (T) of the tip 2 is less than 0.3 mm. When the thickness (T) is less than 0.3 mm, the edged corner 22 of the upper surface 21 of the tip 2 is rounded at the time of applying the laser beam welding so as to increase the voltage required for the spark plug to establish the spark discharge.

The reason why the thickness (T) of the tip 6 is less than 0.6 mm is that the amount of the noble metal not involved in the spark-erosion resistance increases to make it costly when the thickness (T) exceeds 0.6 mm.

Figure 9B:
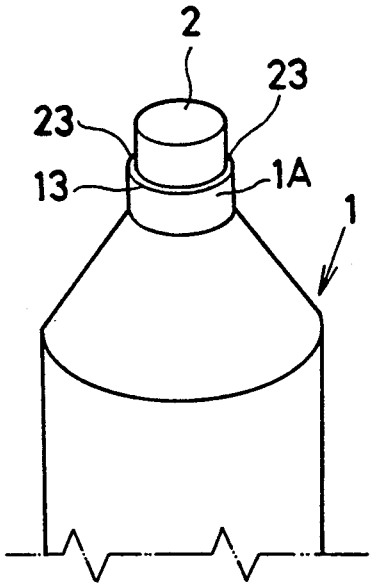

The reason why the dimension $(d-D)/2$ should be in the range of $0\ mm \sim 0.2\ mm$ is as follows:

As shown in FIG. 9*b*, the noble metal tip 2 is welded to the front end 13 of the straight neck portion 1A by means of the laser beam welding. In this instance, when the straight neck portion 1A is diametrically same as the noble metal tip 2, the heat of the laser beams (Lb) is evenly absorbed by the tip 2 and the clad metal 11 since there is no stepped surface therebetween at the points 23 in which the laser beams (Lb) are applied. However, when there is a stepped portion at the interface more than 0.2 mm, the heat of the laser beams (Lb) is dispersed to be insufficient in the welding portion penetrated into the interface so as to vary the penetrated depth of the welding portion. The dimension $(d-D)/2$ is preferably in the range of $0.1\ mm \sim 0.15\ mm$.

When the length (L) of the straight neck portion 1A is less than 0.2 mm, the heat of the laser beam welding is partially drawn from the clad metal 11 to the heat-conductive core 12. This makes it difficult to evenly melt the tip 2 and the straight neck portion 1A each other.

When the length (L) of the straight neck portion 1A exceeds 0.5 mm, the clad metal 11 is exposed to an increased amount of the laser beam heat so as to develop blow holes or cracks in the welding solidification portion 3 at the time of carrying out the laser beam welding particularly because the clad metal 11 has a melting point smaller than the tip 2.

According to the second embodiment of the invention, the tip 2 is secured to the straight neck portion 1A by means of the laser beam welding so that the tip 2 is prevented from buckling down while keeping the corner of the tip 2 in good shape. The use of the laser beam welding makes it possible to weld the electrode materials which has melting point higher than platinum, and difficult to weld by means of electric resistance welding.

It is appreciated that in order to impart the spark-erosion resistant property, the disc-shaped tip 2 may be made of Ru, W or Cr instead of Au, Pt or Ir.

It is noted that an argon welding and electron beam welding may be used instead of the laser beam welding.

It is also noted that when a ground electrode is prepared, the ground electrode may be made in integral with the metallic shell instead of welding it to the metallic shell.

Further, it is appreciated that when a ground electrode is prepared, the ground electrode may be made of a composite column in which a copper core is embedded in a clad metal in the same manner as the electrode blank metal 1 is made at the embodiment of the invention.

While the invention has been described with reference to the specific embodiments, it is understood that this description is not to be construed in a limiting sense in as much as various modifications and additions to the specific embodiments may be made by skilled artisan without departing from the spirit and scope of the invention.

What is claimed is:

1. In a method of making a spark plug which includes an electrode blank metal having a barrel portion and a diameter-reduced straight neck portion to which a erosion resistant disc-shaped tip is secured:

the method comprising steps of:

(i) preparing an electrode blank metal having a barrel portion and a diameter-reduced straight neck portion;

(ii) providing a recess on a front end surface of the electrode blank metal, a diameter of the recess being greater than that of a disc-shaped tip;

(iii) providing a straight neck portion on a front end of the electrode blank metal in a manner to surround the recess, and forming a tapered surface progressively connecting from the straight neck portion to the barrel portion, a diameter of the straight neck portion being greater than that of the recess but smaller than that of the barrel portion;

(iv) placing a disc-shaped tip in the recess of the electrode blank metal;

(v) pressing the disc-shaped tip against an inner bottom of the recess in the axial direction of the electrode blank metal, and applying a laser beam welding to an outer wall of the recess substantially all through its circumferential length by rotating the electrode blank metal, and forming a welding solidification portion all through the outer wall of the recess.

2. A method of making a spark plug as recited in claim 1, wherein step (iii) precedes the step (ii).

3. A method of making a spark plug as recited in claim 1, wherein a dimensional relationship on D, T, A, B, d and L is as follows:

$$0.5\ \text{mm} \leqq D \leqq 1.5\ \text{mm},$$

$$0.3\ \text{mm} \leqq T \leqq 0.6\ \text{mm},$$

$$0.01\ \text{mm} \leqq (A-D) \leqq 0.1\ \text{mm},$$

$$0.05\ \text{mm} \leqq B \leqq 0.2\ \text{mm},$$

$$0.05\ \text{mm} \leqq (d-A)/2 \leqq 0.2\ \text{mm}$$

$$0.2\ \text{mm} \leqq L \leqq 0.5\ \text{mm}$$

where (D) is a diameter of the disc-shaped tip, (T) is a thickness of the disc-shaped tip, (A) is a diameter of the recess, (B) is a depth of the recess, (d) is a diameter of the straight neck portion, and (L) is a length of the straight neck portion.

4. In a method of making a spark plug which includes an electrode blank metal having a barrel portion and a diameter-reduced straight neck portion to which a erosion resistant disc-shaped tip is secured:

the method comprising steps of:

(i) preparing an electrode blank metal having a barrel portion and a diameter-reduced straight neck portion (ii) forming a tapered surface progressively connecting from the straight neck portion to the barrel portion;

(iii) concentrically placing a disc-shaped tip on a front end surface of the electrode blank metal;

(vi) axially pressing the disc-shaped tip against the front end surface of the electrode blank metal, and applying a laser beam welding to an interface between the disc-shaped tip and the front end surface of the electrode blank metal substantially all through its circumferential length by rotating the electrode blank metal, and forming a welding solidification portion all through the interface therebetween.

5. A method of making a spark plug as recited in claim 4, wherein a dimensional relationship on D, T, d and L is as follows:

$$0.5\ \text{mm} \leqq D \leqq 1.5\ \text{mm},$$

$$0.3\ \text{mm} \leqq T \leqq 0.6\ \text{mm},$$

$$0.\ \text{mm} \leqq (d-D)/2 \leqq 0.2\ \text{mm},$$

$$0.2\ \text{mm} \leqq L \leqq 0.5\ \text{mm}.$$

where (D) is a diameter of the disc-shaped tip, (T) is a thickness of the disc-shaped tip, (d) is a diameter of the straight neck portion and (L) is a length of the straight neck portion.

6. A method of making a spark plug as recited in claims 1, 2, 3, 4 or 5, wherein the disc-shaped tip is made of a noble metal.

* * * * *